US006117058A

United States Patent [19]

Sauder et al.

[11] Patent Number: 6,117,058

[45] Date of Patent: Sep. 12, 2000

[54] BAG MAKING MACHINE

[75] Inventors: Charles Sauder, Appleton; Edward Clemons, Neenah; Michael Stickney, Appleton, all of Wis.

[73] Assignee: CMD Corporation, Appleton, Wis.

[21] Appl. No.: 08/874,393

[22] Filed: Jun. 13, 1997

[51] Int. Cl.[7] ..... B31B 1/64

[52] U.S. Cl. ..... 493/193; 493/197; 493/198

[58] Field of Search ..... 53/389.4; 493/2, 493/34, 197, 193, 196, 198, 202, 205, 208

[56] References Cited

U.S. PATENT DOCUMENTS

| | | | |
|---|---|---|---|
| 4,114,520 | 9/1978 | Achelpohl et al. . | |
| 4,642,084 | 2/1987 | Geitman . | |
| 4,934,993 | 6/1990 | Geitman . | |
| 4,991,376 | 2/1991 | Backman | 53/389.4 X |
| 5,417,638 | 5/1995 | Anderson et al. . | |
| 5,447,486 | 9/1995 | Anderson et al. . | |
| 5,518,559 | 5/1996 | Saindon et al. . | |
| 5,587,032 | 12/1996 | Saindon et al. . | |
| 5,830,117 | 11/1998 | Anderson . | |

FOREIGN PATENT DOCUMENTS

| | | |
|---|---|---|
| 3209496 A1 | 3/1982 | Germany . |

*Primary Examiner*—Linda Johnson
*Attorney, Agent, or Firm*—George R. Corrigan

[57] ABSTRACT

A plastic bag making machine is disclosed, and includes a dancer assembly that receives film from which the bags are to be made. The film travels from the dancer assembly to a drum-in nip and then to a sealing drum. After the sealing drum, the film travels to a drum-out nip. Then the film travels to a device-in nip, vertically through a processing device, and then to a device-out nip. A controller is connected to and controls the drum-in nip, the drum-out nip, the device-in nip, the device out nip, the dancer assembly and the sealing drum (including the seal bars and/or the sealing blanket drives). The controller includes a memory in which at least one set of operating parameters used to control the machine is stored.

3 Claims, 2 Drawing Sheets

BAG MAKING MACHINE

FIELD OF THE INVENTION

The present invention relates generally to the art of bag making machinery. More specifically, it relates to a bag making machine having a rotary sealing drum.

BACKGROUND OF THE INVENTION

Many different types of plastic bag making machines are known in the art of producing plastic bags for industrial and individual consumers for many different applications (e.g. small sandwich bags and trash bags). A discussion of the history and operation of these machines can be found in U.S. Pat. No. 4,642,084 (hereby incorporated by reference) entitled "Plastic Bag Making Machine", assigned to the present assignee. The '084 patent discloses a bag machine which includes a rotary drum with seal bars attached thereto. Prior art machines maintain the position of the seal bars (at the drum periphery) using air cylinders. Improvements made to that design are described in other patents assigned to the present assignee, including U.S. Pat. Nos. 4,934,993, 5,518,559 and 5,587,032. Generally, the machines implementing these inventions have been well received.

A prior art bag making machine constructed generally in accordance with the descriptions of the above referenced patents is shown in FIG. 1. The major elements of such a prior art bag making machine 10 include a dancer and idler assembly 12, a sealing drum and blanket assembly 14, a chill roll 16, a controller 15, a punching station 17, a folding station 18, a pull roll system 20, a perforator/cutting station 22 and a phase variator assembly 24.

Film 11 is fed in the direction of the arrows from a source of plastic tubing 13 through a dancer roll 12*b* and an idler roll 12*b* into the sealing drum and blanket assembly 14. Source 13 may be any source for plastic material such as an extruder, a roll of plastic film, or a printer on which the plastic is imprinted. Dancer roll 12*a* exerts a known tension on the film by pulling it in a downward direction. The position of dancer roll 12*a* is used to determine the actual speed (by determining the difference from a nominal speed). The nominal tension is adjusted pneumatically. The adjustment may be difficult for the user because the adjustments are counter-intuitive: increasing pressure on the dancer cylinder decreases film tension.

The sealing drum and blanket assembly 14 includes a cylindrical drum 28, which is capable of being varied in diameter. That feature is illustrated by the dotted circle illustrating a smaller diameter. A number of sealing bars 30 are also shown and periodically form cross seals across the flattened film tube 11. Sealing bars 30 are of conventional design and are disclosed in detail with respect to construction and operation in the '084 patent. A blanket 32 is mounted on rollers 34, 35, 36 and 37 for surrounding a portion of drum 28 in such a way that the film 11 passes between blanket 32 and drum 28 while seals are being formed. Rollers 34 and 35 are mounted to an elongate frame 39 which is pivotable between the solid and dotted line positions shown in FIG. 1. Frame 39 includes a perpendicular plate 40 near its midsection, the latter being coupled to an air cylinder 42 having an extensible rod 43. It will be appreciated that extension of rod 43 causes rollers 34 and 35 to move to the dotted line position when the drum diameter decreases, thereby maintaining tension of blanket 32 against drum 28.

Roller 37 is driven from a gear motor 44 by belt 45 to drive blanket 32, and in turn blanket 32 will rotate drum 28 due to the tension between these components. Motor 44 includes an encoder 47 which generates a position signal each revolution of motor 44. Alternative encoder locations are on roller 37 or roller 38. A detector 23, such as an electric eye or magnetic sensor is positioned directly above drum 28 and generates a signal when a small metal or magnetic protrusion 26 on drum 28 passes, i.e. each revolution of drum 28. From the output of encoder 47 and detector 23 the circumference of drum 28 and the linear travel of film 11 bag are determined by controller 15. In an alternative embodiment encoder 47 may be mounted via a pulley to roller 37 or roller 36.

After passing chill roll 16, the film 11 next passes through an optional punching station 17 which punches preselected hole and handle configurations in the film. Thereafter, the film may be further processed as shown or in any other appropriate manner.

Variator system 24 is driven from a gear box 63 by belt 64. Gear box 63 is driven by drum 28 through belt 65. Variator system 24 also includes a pair of gears 66 and 67, used to vary the phase of the perforator/cutting station 22 and punching station 17, respectively, or any other type of downstream device.

Prior art rotary sealing drums in general perform better when the film is not under tension when it is sealed. However, as the film travels through other parts of the machine it is desirable to place it under tension to control and drive it. Thus, prior art machines overspeed the film as it approaches the sealing drum. The roll where the film contacts the blanket is referred to as the lay on roll, and it assists in overspeeding the film. The blanket is driven at the speed of the machine. As the blanket moves around the lay on roll the outside of the blanket (relative to the lay on roll) travels faster than the inside of the blanket (which is at the machine speed). As the film passes around the lay on roll, it is on the outside of the blanket. Since film 11 is in contact with the outside of blanket 32, it too travels faster than the machine speed. An analogous effect occurs when the film's contact with the blanket ends.

The prior art was thus limited in the ability to overspeed the film (i.e. it was determined largely by the blanket thickness. Additional control was obtained by an additional nip and the user needed to adjust the tension of the dancer rolls when adjusting the overspeed. Also, a mechanical adjustment was made when product size was changed. Another drawback was the blanket needed to be able to hold the film when oversped, yet it still needed to be slick enough to release the film after sealing.

Prior art machines have a variety of controllable parameters, including dancer tension and the overspeeding of the lay on roll and chill roll (the roll following the drum). These adjustments were individually made, and required the user to make mechanical adjustments. The adjustments were made by observing the film being processed, and adjusting the settings. Thus, it is difficult for inexperienced operators to make the proper adjustments.

FIG. 1 shows a perforator or cutter 22 (a knife) used to perforate the location demarking the end of one bag and the beginning of the next. The film path through the knife is horizontal, which causes difficulty in threading. Also, the knife is mechanically driven with a variator. The user adjusts for tension using a magnetic particle clutch or an ac vector drive. These adjustments are also made by observing the process.

According, a bag making machine that provides a dancer assembly exerting upward tension is desirable. Also, it will preferably have a sealing drum with infeed and outfeed nips, such as servo driven nips, that control the web speed to provide sealing with reduced or no tension. Such a machine will also have controls that allow an inexperienced user to operate the machine.

SUMMARY OF THE PRESENT INVENTION

According to a first aspect of the invention a plastic bag making machine includes a sealing drum with a driven sealing blanket and an upstream drum-in nip, wherein the film travels from the drum-in nip to the drum. A controller is connected to the drum-in nip and the sealing drum (including the seal bars and/or blanket drive). The controller includes a memory in which at least one set of operating parameters used to control the machine is stored.

The drum-in nip is formed with at least one drum-in servo-drive roll according to one alternative. The speed of the drum-in roll is controlled by the controller.

Another alternative includes a drum-out nip, wherein the film travels from the drum to the drum-out nip. The drum-out nip is formed with at least one drum-out servo-driven roll. The speed of the drum-out roll is controlled by the controller.

Other alternatives include an input device for the controller to select one of a set of operating parameters and/or to enter the at least one set of operating parameters.

Another aspect of the invention is a plastic bag making machine including a sealing drum and a downstream processing device. There are nips before and after the device. A controller connected to the nips and the sealing drum (which includes the seal bars and/or the blanket drives) has a memory in which at least one set of operating parameters used to control the machine are stored.

Yet another aspect of the invention is a controller for a plastic bag making machine that has an input used to select one of a set of operating parameters and to enter the at least one set of operating parameters, and a memory that stores the at least one set, and at least one output for controlling the machine.

Another aspect of the invention is a plastic bag making machine having a sealing drum and a processing device. The film travels through the processing device along a predominantly vertical path.

Another aspect of the invention is a plastic bag making machine that includes a dancer assembly that receives a film from which the bags are to be made. An air cylinder is connected to the dancer assembly. The film travels from the dancer assembly to a sealing drum. The speed of the machine is dependent on the position of the air cylinder, and a controller senses the position of the air cylinder.

An alternative is providing the controller with an input used to select the air cylinder pressure, and/or used to store the pressure.

Other principal features and advantages of the invention will become apparent to those skilled in the art upon review of the following drawings, the detailed description and the appended claims.

Figure 1:
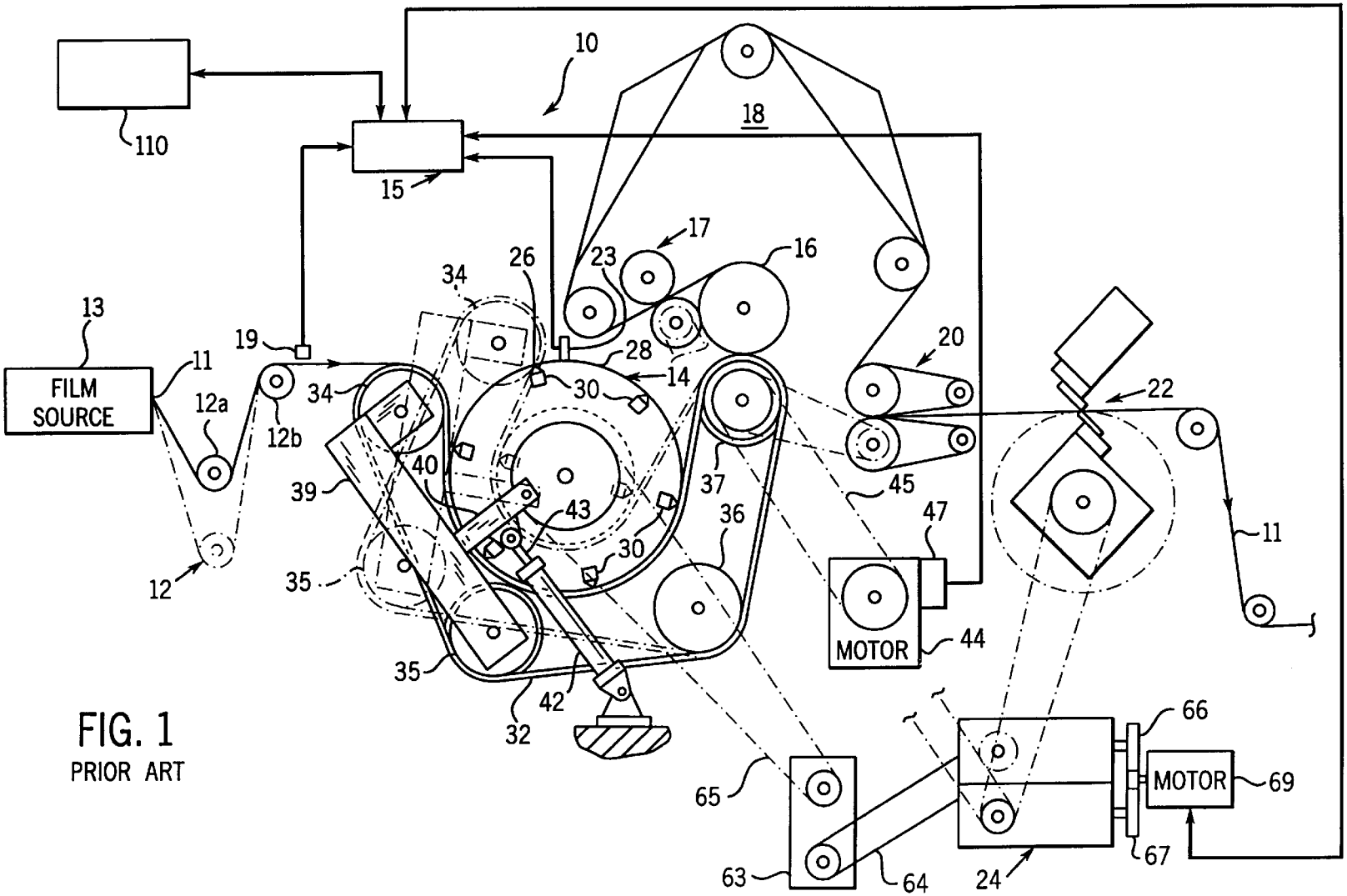
FIG. 1 PRIOR ART
FIG. 1 is a diagram of a prior art bag making machine with a rotary sealing drum.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a rotary drum sealer in a bag making machine, having particular servo drives and control inputs, it should be understood at the outset that the inventions may be practiced by making changes to the preferred embodiment, including omitting, substituting therefor or adding features.

Figure 2:
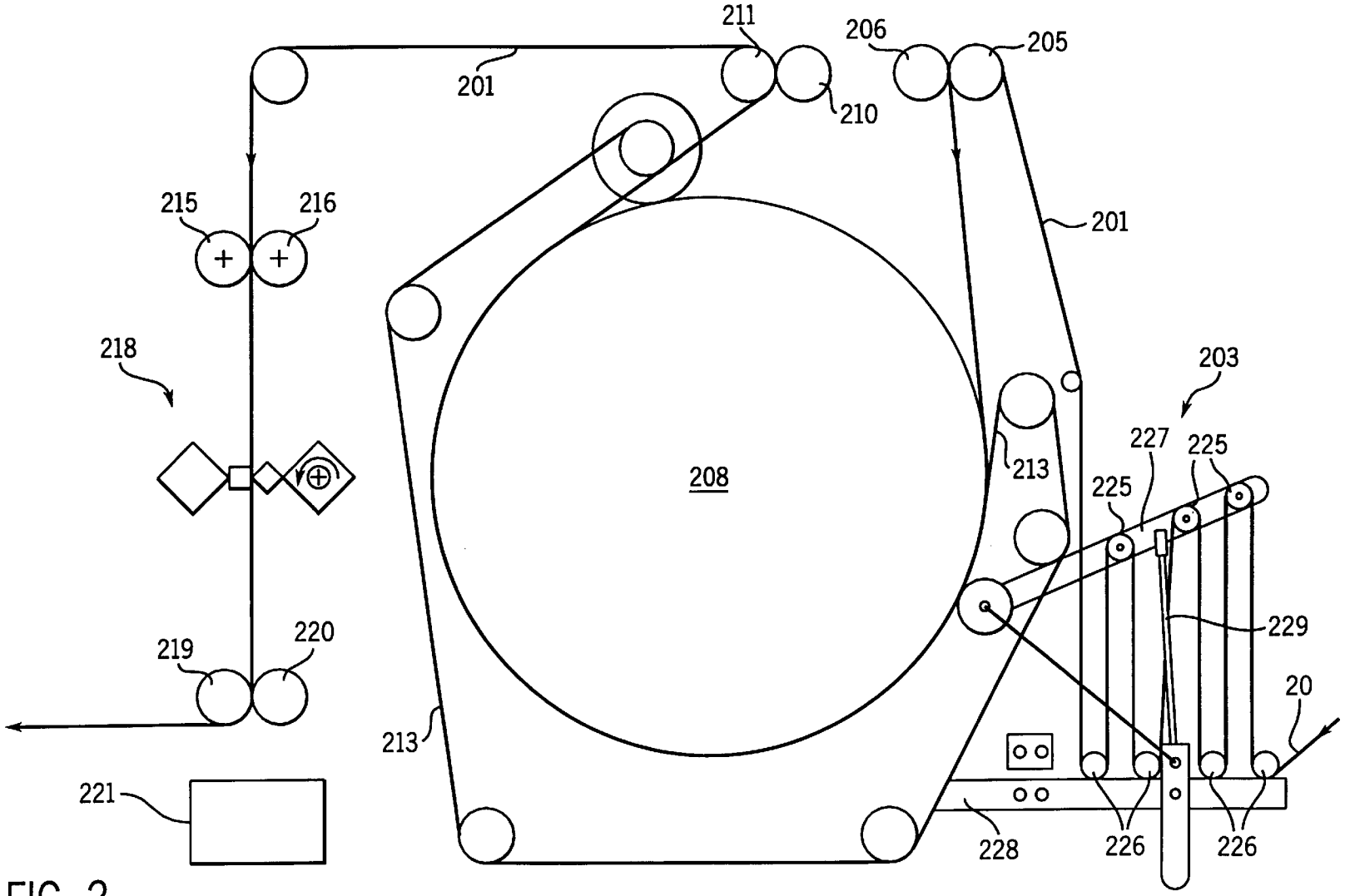
FIG. 2 is a diagram of a portion of a bag making machine constructed in accordance with the preferred embodiment.

FIG. 2 shows the preferred embodiment of the present invention which processes a film 201 using a dancer assembly 203, a pair of drum-in rolls 205 and 206, a sealing drum 208, a pair of drum-out rolls 210 and 211, a sealing blanket 213, a pair of knife-in rolls 215 and 216, a knife 218 (which could be any other film processing device such as a perforator, knife, die cutter, punching station, or folding station), a pair of knife-out rolls 219 and 220, and a controller 221.

Sealing drum 208 is, in the preferred embodiment, constructed generally in accordance with the prior art cited above, although it could be made using a different design. It has a variable diameter of from 96 to 152 inches. The particular type of drum is not important for the present invention. As shown in FIG. 2, the processing device is located downstream of the drum, thus the film travels from the drum to the processing device.

One change in drum 208 from the prior art is the provision of a retractable sealing bar. The bar may be retracted during operation so that the user can more readily correlate individual seals with individual sealing bars. This is useful in the event that one sealing bar is not functioning properly, and allows the user to identify the malfunctioning seal bar. The preferred embodiment provides a valve on the air cylinder of one seal bar. The valve is used to vent the cylinder, thus retracting the seal bar. The position of the valve is controlled by controller 221. Controller 221 causes the bar to be retracted when the user makes an appropriate input to controller 221.

Dancer assembly 203 includes a plurality of upper rolls 225 and lower rolls 226. Rolls 225 and 226 are mounted on arms 227 and 228, which are pivotally inter-connected. An air cylinder 229 is used to adjust the tension applied to film 201. The vertical distance between rolls 225 and 226 is determined by the tension applied to film 201 (and is related to the speed of film 201). As may be seen, increasing the air pressure moves upper rolls 225 farther from rolls 226 and increases the tension on film 201. Thus, the control is intuitive: more pressure moves the rolls up and thus increases tension.

Air cylinder 229 is controlled with an air regulator, which is controlled by controller 221. Because an air cylinder and air regulator are used, and controlled by controller 221 (or in operative association therewith), adjustments may be made easily, and operating parameters stored for a number of different products (types of film, bag length, etc.). Also, the position of dancer rolls 225, as sensed by controller 221, is used by controller 221 to determine the speed of the film 201. The operation and use of controller 221 will be described in greater detail below. Alternative embodiments include using a different number of dancer rolls, other arrangements to control the position of the dancer rolls (including pneumatics and mechanical drives), and using a dancer that increases tension by moving a roll downward.

After leaving dancer assembly 203 film 201 is directed to drum-in rolls 205 and 206. As used herein drum-in rolls mean rolls preceding the drum. Roll 205 is a servo-driven roll in the preferred embodiment, and roll 206 is an idler roll in the preferred embodiment. Rolls 205 and 206 are rubber wrapped. Of course, other roll arrangements may be used as well. FIG. 2 shows that only film 201 passes through the drum-in nip (between rolls 205 and 206). A blanket 213 is used to hold the film to the sealing drum, but the film does not contact blanket 213 until after the drum-in nip.

Servo-driven roll 205 is used to overspeed the film. Controller 221 causes roll 205 to be driven at a speed greater than the machine speed (and the speed of the film through dancer assembly 203) by a user selected percentage. The speed of roll 205 is thus linked electronically, rather than mechanically, to the machine speed. The user selects the percent overspeed based on observation, or from a set of control parameters stored by controller 221. Thus, controller 221 uses the nominal (or base) speed, the position of rolls 225 of dancer assembly 203 and the user entered overspeed to set the speed of roll 205. Thus, the film may be sealed under little or no tension.

The overspeed is not limited by blanket thickness, and may be made as large as the user desires (and the film will tolerate). Alternatively, controller 221 could be used to sense tension, and determine an appropriate overspeed (rather than the users percentage input overspeed).

Drum-out rolls 210 and 211 are used to slow down film 201, and reintroduce tension. As used herein drum-out roll means a roll downstream of the drum. Roll 211 is a servo driven roll and is driven at an underspeed equal to the overspeed of roll 205. Thus, the film will be returned to the same tension, and the same speed, that it was at prior to sealing. Rolls 210 and 211 are both rubber wrapped rolls, and roll 211 is an idler roll. Alternatively, the user could input an underspeed independent of the overspeed, or select only the underspeed and have the controller determine the overspeed. Also, the alternatives discussed above may be implemented for rolls 210 and 211.

The over and under speed arrangement of the present invention is thus easily controlled, performed by servo-driven rolls, and occurs when blanket 213 is not in contact with the film. Film 201 is only in contact with blanket 213 when they are against drum 208. Accordingly, blanket 213 to drive film 201 only when film 201 is sandwiched between drum 208 and blanket 213, and it may be possible to choose a surface of blanket 213 that more easily releases film 201, such as a cross linked urethane.

After film 201 leaves drum 208 and drum-out rolls 210 and 211, it is directed to knife 218. Knife 218 is disposed such that the film path therethrough is vertical. This allows for easier threading of the knife than if it were disposed horizontally. The threading will be easier so long as the path is predominantly vertical (more than a 45 degree angle to horizontal), although substantially vertical is preferred.

Knife-in rolls 216 and 215 are provided to more accurately control the speed of film 201 as it passes through knife 218. At least one of rolls 215 and 216 is servo driven and controlled by controller 221. Similarly, at least one of rolls 219 and 220 is servo driven and controlled by controller 221. The user inputs a percent over/under speed into controller 221, and the knife-in and knife-out rolls are driven to the selected speed. As used herein knife-in and knife-out rolls refer to rolls upstream and downstream of the knife. It may be desirable for the film to be under more or less tension when being cut, so the user can select either. Alternatively, the user could select the speed of the knife-in rolls, and controller 221 could assign a speed to the knife-out rolls that returns the film to the original speed.

Controller 221 has control outputs (not shown) connected to the various servo and other driven rolls, the air regulator that controls air cylinder 229, dancer assembly 203, drum 208 (which includes outputs to the seal bars and/or the blanket drives), knife 218 to control these elements. Alternatives include having controller 221 control fewer or more components. Controller 221 includes a touch pad, in the preferred embodiment, that allows the user to input various control parameters. These parameters include dancer pressure (PSI), overspeed of the drum-in nip (%), underspeed of the drum-out nip (%), overspeed of the knife-in nip (%), underspeed of the knife-out nip (%), and the temperature of the seal bars on drum 208. Alternative embodiments include the use of other sets of control parameters.

Controller 221 includes a Giddings & Lewis PIC 900 PLC. Other microprocessor or analog based controllers could be used. The PLC includes a memory in which sets of operating parameters are stored. Up to 50 sets of parameters are stored in the preferred embodiment. Each set is intended to be used with a particular type of bag being made. Hopefully, a skilled operator initially chooses the parameters by observing the process (or they could be factory set). Thereafter, the user only needs to select the correct set for the bag being made, and thus does not need much experience to run the machine. The various parameter sets could be accessed by number, where the user knows that, for example, set 5 is to be used for bag A. Alternatively, controller 221 could store bag types, and the user need only identify bag type being made, or input bag parameters such as film width, thickness etc.

Other embodiment provide for common types of bags to have default parameters that could be adjusted by the user. The default parameters could be factory set, or set by an experienced user. Alternatively, film parameters, such as width and thickness could be determined by controller 221 using sensors such as photocells, the tension on dancer assembly 203 could be sensed (and speed determined) and controller 221 could calculate a parameter set using a formula or look-up table. The calculated parameter sets could be implemented by the user, or altered as needed.

Numerous modifications may be made to the present invention which still fall within the intended scope hereof. Thus, it should be apparent that there has been provided in accordance with the present invention a method and apparatus for making plastic bags that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A plastic bag making machine comprising:

a dancer assembly that receives a film from which the bags are to be made;

a sealing drum;

a drum-in nip formed from at least two rolls, wherein the film travels from the dancer to the drum-in nip, and then to the drum;

a controller connected to the drum-in nip and disposed to sense tension in the web downstream of the drum-in nip, wherein the speed of the drum-in nip is controlled by the controller in response to the sensed tension.

2. The apparatus of claim 1 wherein the controller includes an input used to select a one of an at least one set of operating parameters stored in the controller.

3. The apparatus of claim 1 wherein the controller includes an input used to enter an at least one set of operating parameters stored in the controller.

* * * * *